US008092571B2

(12) United States Patent
Park et al.

(10) Patent No.: US 8,092,571 B2
(45) Date of Patent: Jan. 10, 2012

(54) COMBUSTION REACTORS FOR NANOPOWDERS, SYNTHESIS APPARATUS FOR NANOPOWDERS WITH THE COMBUSTION REACTORS, AND METHOD OF CONTROLLING THE SYNTHESIS APPARATUS

(75) Inventors: Jong-Ku Park, Gyeonggi-do (KR); Jae-Pyoung Ahn, Seoul (KR); Hyoung-Chul Kim, Seoul (KR); Seung-Yong Lee, Gyeonggi-do (KR); Hyun-Seock Jie, Seoul (KR); Hoon Park, Gyeonggi-do (KR)

(73) Assignee: Korea Institute of Science and Technology, Seoul (KR)

( * ) Notice: Subject to any disclaimer, the term of this patent is extended or adjusted under 35 U.S.C. 154(b) by 676 days.

(21) Appl. No.: 11/911,336

(22) PCT Filed: Dec. 30, 2005

(86) PCT No.: PCT/KR2005/004680

§ 371 (c)(1),
(2), (4) Date: Oct. 11, 2007

(87) PCT Pub. No.: WO2006/129908

PCT Pub. Date: Dec. 7, 2006

(65) Prior Publication Data

US 2008/0314202 A1 Dec. 25, 2008

(30) Foreign Application Priority Data

May 31, 2005 (KR) ..... 10-2005-0046430

(51) Int. Cl.
*B32B 9/30* (2006.01)
*B01J 12/02* (2006.01)

(52) U.S. Cl. ..... 75/363; 266/202; 266/267; 422/232

(58) Field of Classification Search ..... None
See application file for complete search history.

(56) References Cited

U.S. PATENT DOCUMENTS

| | | | | |
|---|---|---|---|---|
| 4,589,260 | A | 5/1986 | Krockow | |
| 5,599,511 | A | 2/1997 | Helble et al. | |
| 5,823,762 | A * | 10/1998 | Anderson et al. | 431/8 |
| 5,852,768 | A | 12/1998 | Jacobsen et al. | |
| 2006/0166057 | A1 * | 7/2006 | Kodas et al. | 429/22 |
| 2008/0318761 | A1 * | 12/2008 | Riedel et al. | 501/134 |

FOREIGN PATENT DOCUMENTS

| | | |
|---|---|---|
| JP | 56150103 | 11/1981 |
| JP | 11257615 | 9/1999 |
| WO | 94/22786 | 10/1994 |

* cited by examiner

*Primary Examiner* — George Wyszomierski
(74) *Attorney, Agent, or Firm* — Fish & Richardson P.C.

(57) ABSTRACT

The present invention relates to a combustion reactor for nanopowders, a synthesis apparatus for nanopowders using the combustion reactor, and a method of controlling the synthesis apparatus. The combustion reactor for nanopowders comprises an oxidized gas supply nozzle connected to an oxidized gas tube; a gas supply unit supplying a fuel gas and a precursor gas; and a reaction nozzle forming concentricity on an inner wall of the oxidized gas supply nozzle to be connected to the gas supply unit and having an inlet opening for supplying an oxidized gas disposed at a region adjacent to a jet orifice for spraying flames. In the present invention, it is possible to precisely control the stability of flames, the uniform temperature distribution of flames and the temperature of flames that affect the properties of nanopowders, and the deposition of oxide in the combustion reactor is prevented to thus enable a continuous and uniform reaction for a long time, thereby enabling an economic and efficient synthesis of nanopowders.

11 Claims, 3 Drawing Sheets

COMBUSTION REACTORS FOR NANOPOWDERS, SYNTHESIS APPARATUS FOR NANOPOWDERS WITH THE COMBUSTION REACTORS, AND METHOD OF CONTROLLING THE SYNTHESIS APPARATUS

CROSS REFERENCE TO PRIOR APPLICATIONS

This application is the U.S. national phase of International Application No. PCT/KR2005/004680, filed Dec. 30, 2005, which claims priority from Korean Application No. 10-2005-0046430, filed May 31, 2005. The disclosures of both applications are incorporated herein by reference in their entirety. The International Application was published in English on Dec. 7, 2006 as WO 2006/129908 A1 under PCT Article 21(2).

TECHNICAL FIELD

The present invention relates to a combustion reactor for nanopowders, a synthesis apparatus for nanopowders using the combustion reactor, and a method of controlling the synthesis apparatus.

BACKGROUND ART

A nanopowder combustion reaction method is a method of synthesizing nanopowders by using a precursor in a gaseous state, liquid state or solid state. Generally, a special combustion reactor (burner) is needed for combustion reaction of a fuel in a gaseous state. The combustion reactor is classified into a diffusion type combustion reactor and a pre-mix type combustion reactor according to a gas supply method.

The diffusion type combustion reactor is a most common form of a combustion reactor, which is generally configured by arranging three cylindrical nozzles for supplying a precursor gas, a fuel gas and an oxidized gas, respectively, in a concentric circle form. The thus-constructed diffusion type combustion reactor is advantageous in that the structure is simple, but has a problem in that it is difficult to induce uniform reaction in the combustion reactor as reaction is made only on a contact surface of each gas because different kinds of gases are supplied via the respective nozzles.

Besides, as oxide grows in the combustion reactor, the oxide is deposited on the nozzle surfaces, which makes it difficult to sustain a continuous and uniform reaction.

The pre-mix type combustion reactor is to pre-mix each of gases in a pre-mixing chamber and then reacting them in a combustion chamber, which was proposed in U.S. Pat. No. 4,589,260 (Title: Premixing Burner with Integrated Diffusion Burner, field: Nov. 4, 1983). Such a pre-mix type combustion reactor is able to solve the aforementioned problem of the diffusion type combustion reactor, however, is problematic in that a precursor gas and fuel gas introduced are easily oxidized or combusted in a mixing process.

Moreover, the form of produced nanopowders depends sensitively on which region of the combustion chamber a reaction occurs at, thus it is hard to precisely control.

DISCLOSURE

Technical Problem

The present invention is directed to overcome the foregoing problems and therefore an object is to provide a synthesis apparatus for nanopowders, which prevents oxide from being deposited on inner walls of reaction nozzles, assures the uniformity of flames and optimizes the structure of a combustion reactor for nanopowders so as to precisely control the temperature of the flames, and a method of controlling the synthesis apparatus.

Technical Solution

To accomplish the above object, there are provided a combustion reactor for nanopowders according to at least one embodiment of the present invention, comprising: an oxidized gas supply nozzle connected to an oxidized gas tube; a gas supply unit supplying a fuel gas and a precursor gas; and a reaction nozzle forming concentricity on an inner wall of the oxidized gas supply nozzle to be connected to the gas supply unit and having an inlet opening for supplying an oxidized gas disposed at a region adjacent to a flame jet orifice, a synthesis apparatus for nanopowders using the combustion reactor and a method of controlling the synthesis apparatus.

By disposing an oxidized gas inlet opening at a region adjacent to a flame jet orifice, the degree of deposition of oxide on an inner wall of the reaction nozzle is reduced, and flames are uniformly formed.

Especially, the oxidized gas inlet opening may be formed in a slit shape, and may be constructed so as to have an angle of inclination of 30 to 60 degrees along the outer surface of the reaction nozzle. In a case where the oxidized gas inlet opening is formed in a slit shape, small branches of flames can be eliminated, and the flames can be maintained uniform. In a case where the oxidized gas inlet opening is constructed to have an angle of inclination of 30 to 60 degrees, it is possible to obtain a titer for synthesis of nanopowders by adjusting the length of flames, the uniformity of a temperature distribution of flames and the amount of oxide to be deposited.

Meanwhile, there is provided a synthesis apparatus for nanopowders according to at least one embodiment of the present invention, comprising: the combustion reactor for nanopowders; an oxidized gas controller for controlling the flow rate of an oxidized gas supplied to an oxidized gas tube; a fuel gas controller for controlling the flow rate of a fuel gas supplied to a fuel gas tube; and a precursor gas controller for controlling the flow rate of a precursor gas supplied to a precursor gas tube.

Additionally, there is provided a method of controlling a synthesis apparatus for nanopowders according to at least one embodiment of the present invention, comprising the steps of: producing a mixed gas by mixing a fuel gas and a precursor gas in a reaction nozzle; introducing an oxidized gas through an oxidized gas inlet opening and reacting the mixed gas with the oxidized gas; and adjusting the angle of inclination of the oxidized gas inlet opening.

Advantageous Effects

According to at least one embodiment of the present invention as described above, it is possible to precisely control the stability of flames, the uniform temperature distribution of flames and the temperature of flames that affect the properties of nanopowders, and the deposition of oxide in the combustion reactor is prevented to thus enable a continuous and uniform reaction for a long time, thereby enabling an economic and efficient synthesis of nanopowders.

MODE FOR INVENTION

Hereinafter, various embodiments of the present invention will be described in detail with reference to the accompanying drawings. However, for the sake of clarity, descriptions of well-known functions or constructions are omitted.

Figure 1:
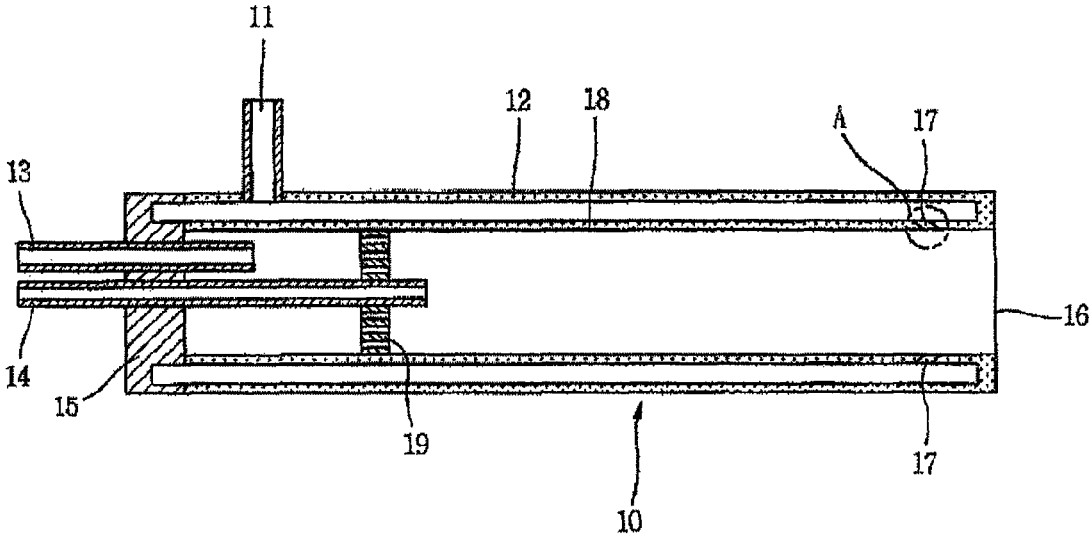
FIG. 1 is a cross sectional view of a combustion reactor for nanopowders in accordance with one embodiment of the present invention.

As shown in FIG. 1, the combustion reactor for nanopowders in accordance with one embodiment of the present invention comprises: an oxidized gas supply nozzle 12 connected to an oxidized gas tube 11; a gas supply unit 15 provided with a fuel gas tube 13 and a precursor gas tube 14; and a reaction nozzle 18 forming concentricity with the oxidized gas supply nozzle 12 in the oxidized gas supply nozzle 12 to be connected to the gas supply unit 15 and having an oxidized gas inlet opening 17 disposed (formed) at a region adjacent to a jet orifice 16 for spraying flames.

Thus, a fuel gas and a precursor gas proceed, being mixed at the front end of the reaction nozzle 18, and start a combustion reaction as an oxidized gas is introduced at the region adjacent to the jet orifice 16 of the reaction nozzle 18. The flames produced as the result of the combustion reaction are sprayed through the jet orifice 16.

Figure 2:
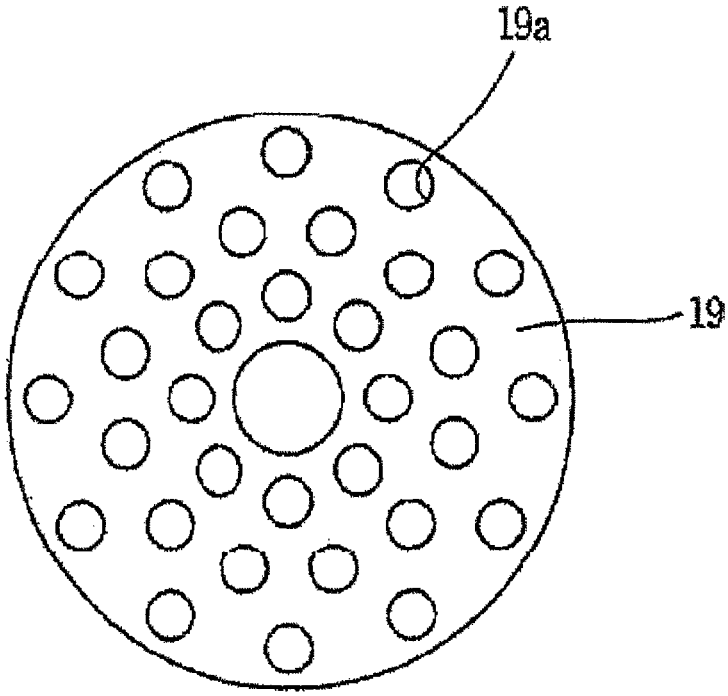
FIG. 2 is a front view of a backflow prevention plate provided at the combustion reactor of FIG. 1.

Here, as shown in FIGS. 1 and 2, it is preferable that a backflow prevention plate 19 where a plurality of voids 19*a* are formed is further comprised so as to partition the inside of the reaction nozzle 18, couple the precursor gas tube 14 thereto by penetration, pass the fuel gas through and prevent the backflow of the precursor gas.

In addition, the oxidized gas inlet opening 17 is disposed alone or in plural numbers at predetermined intervals along the outer circumferential surface of the reaction nozzle 18 so as to uniformly supply the oxidized gas to the mixed gas (of the fuel gas and the precursor gas) passing through the reaction nozzle 18. Thus, the uniformity of flames can be increased.

Besides, there is an advantage that the uniformity of flames can be controlled by adjusting the number of the oxidized gas inlet opening 17.

Figure 3:
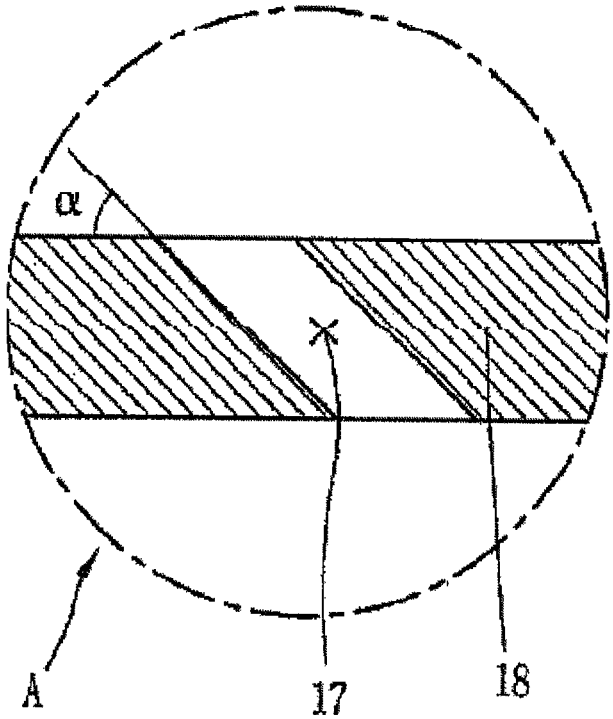
FIG. 3 is a cross sectional view of an enlarged portion of an oxidized gas inlet opening provided at the combustion reactor of FIG. 1.

In this case, as shown in FIG. 3, the flames can be further stabilized by diagonally disposing the oxidized gas inlet opening 17 at an angle of 30 to 60 degrees with respect to the outer circumferential surface of the reaction nozzle 18. If the angle $\alpha$ of inclination is less than 30 degrees, the amount of oxide deposited in the combustion reactor is remarkably reduced, while the length of flames is remarkably larger and the temperature distribution of flames becomes non-uniform.

On the other hand, if the angle $\alpha$ of inclination is more than 60 degrees, the length of flames becomes smaller and the temperature distribution of flames becomes uniform, while the amount of oxide deposited in the combustion reactor is remarkably increased. That is, the angle $\alpha$ of inclination has the critical property that the boundary values are set to 30 degrees and 60 degrees. Within the range of 30 to 60 degrees, as the angle of inclination becomes closer and closer to 60 degrees, the amount of oxide deposited increases, but the length of flames becomes smaller and the temperature distribution of flames becomes more uniform. In contrast, as the angle of inclination becomes closer and closer to 30 degrees, the length of flames becomes smaller and the uniformity of the temperature distribution of flames becomes lower, but the amount of oxide deposited decreases. Thus, it is possible to set an optimum condition for obtaining a required combustion reaction by properly adjusting the angle of inclination within the range of 30 to 60 degrees.

Figure 4:
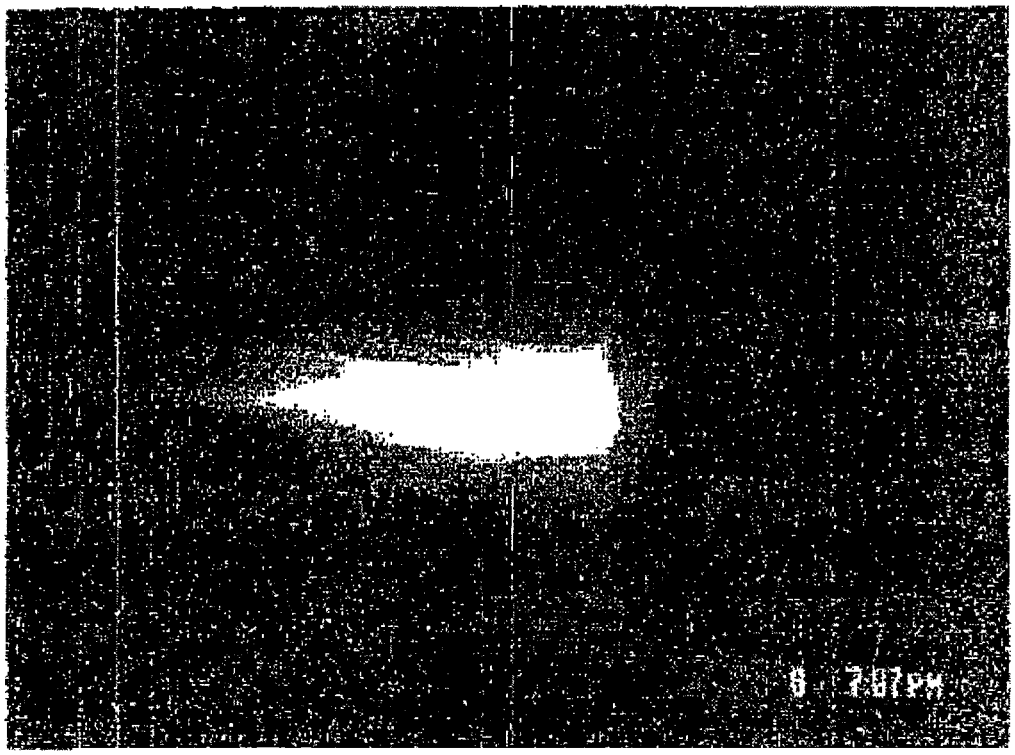
FIG. 4 is a photograph of flames generated as the result of combustion reaction by using methane (CH4), oxygen (O2) and nitrogen (N2) as a fuel gas, an oxidized gas and a precursor gas, respectively, and setting their flow rate to 0.3 slm (standard liter per meter), 3 slm and 0.5 slm.

Meanwhile, FIG. 4 shows the shape of flames formed in the case that a plurality of hole-shaped oxidized gas inlet openings 17 are disposed along the outer circumferential surface of the reaction nozzle 18. In the case that the oxidized gas inlet opening 17 is constructed not in a hole shape in a slit shape, there is an advantage that small branches of the flames as shown in FIG. 4 are eliminated and the flames become uniform.

As the result of causing reaction by setting the diameter of the oxidized gas supply nozzle 12 to 35 mm, the diameter of the reaction nozzle 18 to 20 mm, the intervals between the slit-shaped oxidized gas inlet openings 17 to 0.5 mm, the angle of inclination to 45 degrees and the diameter of the oxidized gas tube 11, fuel gas tube 13 and precursor gas tube 14 to 0.25 inches in the combustion reactor 10 for nanopowders in accordance with the embodiment of the present invention, it can be confirmed that a stable combustion reaction with uniform temperature distribution of flames can be sustained for a long time, and no oxide deposition takes place in the combustion reactor.

Figure 5:
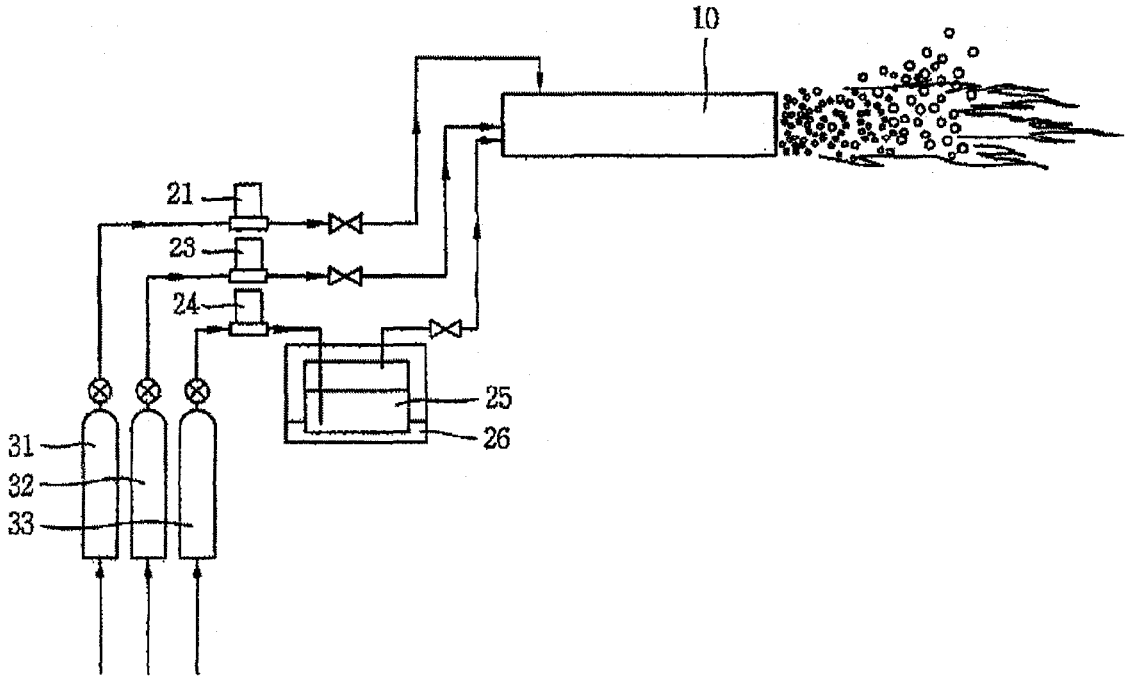
FIG. 5 is a schematic view of a synthesis apparatus for nanopowders using the combustion reactor of FIG. 1.

As shown in FIG. 5. the synthesis apparatus for nanopowders in accordance with another embodiment of the present invention comprises: the combustion reactor 10 for nanopowders; an oxidized gas controller 21 for controlling the flow rate of an oxidized gas supplied to an oxidized gas tube 11; a fuel gas controller 23 for controlling the flow rate of a fuel gas supplied to a fuel gas tube 13; and a precursor gas controller 24 for controlling the flow rate of a precursor gas supplied to a precursor gas tube 14. Therefore, by properly adjusting the flow rate of the oxidized gas, fuel gas and precursor gas introduced into the combustion reactor 10, various flames can be obtained according to need, and resultantly, proper nanopowders can be synthesized.

In this case, a precursor in a liquid state can be vaporized into a precursor gas by further comprising a vaporizer 25 between the precursor gas controller 24 and the precursor gas tube 14. Preferably, the vaporizer 25 is mounted in an oil bath 26.

In FIG. 4, there are illustrated the flames produced as the result of reaction by using methane (CH4) as the fuel gas of the thus-constructed synthesis apparatus of nanopowders, nitrogen (N2) as the precursor gas and oxygen (O2) as the oxidized gas and setting their flow rate to 0.3 slm (standard liter per meter), 0.5 slm and 3 slm, respectively.

When the flow rate of each gas is properly adjusted, the temperature of the flames increases up to a maximum of 1,450 degrees. The temperature of the flames can be properly controlled by adjusting the mixing ratio of the gases.

Meanwhile, the method of controlling a synthesis apparatus for nanopowders using the combustion reactor 10 comprises the steps of: producing a mixed gas by mixing a fuel gas and a precursor gas in a reaction nozzle 18; introducing an oxidized gas through an oxidized gas inlet opening and reacting the mixed gas with the oxidized gas; and adjusting the angle of inclination of the oxidized gas inlet opening 17.

Therefore, by adjusting the angle of inclination of the oxidized gas inlet opening 17, oxide can be prevented from being deposited in the combustion reactor, and the temperature distribution of flames can be made uniform, and the temperature of flames can be adjusted.

In this case, the step of adjusting the number of the oxidized gas inlet opening 17 can be further comprised. If the number of the oxidized gas inlet opening 17 increases, the oxidized gas can be reacted with the mixed gas more uniformly. Thus, the temperature of flames can be adjusted by adjusting the number thereof according to need.

Besides, it is possible to obtain flames having various temperature distributions according to need by further comprising the step of adjusting the flow rate of the fuel gas, precursor gas and oxidized gas.

In the drawings, unexplained reference numeral 31 denotes an oxidized gas supplier, 33 denotes a fuel gas supplier, and 33 denotes a precursor gas supplier.

Although a single embodiment of the invention has been described for illustrative purposes, the scope of the invention is not to be limited, and the present invention is not limited to such specific embodiments, and various modifications and applications may be made within the scope of the claims.

The invention claimed is:

1. A synthesis apparatus for nanopowders, comprising:

(a) a combustion reactor for nanopowders that comprises:
  (i) an oxidized gas supply nozzle connected to an oxidized gas tube,
  (ii) a gas supply unit provided with a fuel gas tube and a precursor gas tube, and
  (iii) a reaction nozzle forming concentricity on an inner wall of the oxidized gas supply nozzle, the reaction nozzle being connected to the gas supply unit and having an inlet opening for supplying oxidized gas disposed at a region adjacent to a jet orifice for spraying flames;

(b) an oxidized gas controller for controlling the flow rate of an oxidized gas supplied to an oxidized gas tube;

(c) a fuel gas controller for controlling the flow rate of a fuel gas supplied to a fuel gas tube;

(d) a precursor gas controller for controlling the flow rate of a precursor gas supplied to a precursor gas tube; and (e) a vaporizer mounted in an oil bath and connecting the precursor gas controller and the precursor gas tube, and vaporizing a precursor in a liquid state into a precursor gas.

2. An apparatus according to claim 1, the combustion reactor further comprising a backflow prevention plate where a plurality of voids are formed so as to partition the inside of the reaction nozzle, couple the precursor gas tube thereto by penetration, pass the fuel gas through and prevent the backflow of the precursor gas.

3. An apparatus according to claim 2, wherein the oxidized gas inlet opening is disposed in plural numbers at predetermined intervals in a radial pattern along the outer circumferential surface of the reaction nozzle.

4. An apparatus according to claim 1, wherein the oxidized gas inlet opening is diagonally disposed at an angle of 30 to 60 degrees with respect to the outer circumferential surface of the reaction nozzle.

5. An apparatus according to claim 4, wherein the oxidized gas inlet opening is in a slit shape.

6. An apparatus according to claim 5, wherein the diameter of the oxidized gas supply nozzle is 35 mm, the diameter of the reaction nozzle is 20 mm, the slit interval of the oxidized gas inlet openings is 0.5 mm, and the diameter of the oxidized gas tube, the fuel gas tube and the precursor gas tube is 0.25 inches.

7. A method of controlling a synthesis apparatus for nanopowders according to claim 1, comprising the steps of:

producing a mixed gas by mixing a fuel gas and a precursor gas in a reaction nozzle;

introducing an oxidized gas through an oxidized gas inlet opening and reacting the mixed gas with the oxidized gas; and adjusting the angle of inclination of the oxidized gas inlet opening.

8. A method according to claim 7, further comprising the step of adjusting the number of the oxidized gas inlet opening.

9. A method according to claim 7, further comprising the step of adjusting the flow rate of the fuel gas, precursor gas and oxidized gas.

10. A method according to claim 9, wherein the angle of inclination of the oxidized gas inlet opening is adjusted within the range of 30 to 60 degrees with respect to the outer circumferential surface.

11. A method according to claim 10, wherein the fuel gas is methane, the precursor gas is nitrogen and the oxidized gas is oxygen, and the amount of methane is 0.3 slm, the amount of nitrogen is 0.5 slm and the amount of oxygen is 3 slm.

* * * * *